US011840769B2

(12) United States Patent
Kulinsky et al.

(10) Patent No.: US 11,840,769 B2
(45) Date of Patent: Dec. 12, 2023

(54) GUIDED TEMPLATE BASED ELECTROKINETIC MICROASSEMBLY (TEA)

(71) Applicant: THE REGENTS OF THE UNIVERSITY OF CALIFORNIA, Oakland, CA (US)

(72) Inventors: Lawrence Kulinsky, Irvine, CA (US); Tuo Zhou, Irvine, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 0 days.

(21) Appl. No.: 17/314,708

(22) Filed: May 7, 2021

(65) Prior Publication Data

US 2021/0348289 A1 Nov. 11, 2021

Related U.S. Application Data

(60) Provisional application No. 63/022,249, filed on May 8, 2020.

(51) Int. Cl.
*C25D 1/00* (2006.01)
*C25D 13/00* (2006.01)

(52) U.S. Cl.
CPC ..... *C25D 1/006* (2013.01)

(58) Field of Classification Search
None
See application file for complete search history.

(56) References Cited

U.S. PATENT DOCUMENTS

2003/0102222 A1* 6/2003 Zhou ..... C25D 13/00 205/67
2010/0007266 A1* 1/2010 Kim ..... C25D 13/02 313/496
2012/0326310 A1* 12/2012 Busnaina ..... H01L 23/53242 977/773

FOREIGN PATENT DOCUMENTS

WO WO-2012020711 A1 * 2/2012 ..... B01L 3/502761

* cited by examiner

*Primary Examiner* — Louis J Rufo
(74) *Attorney, Agent, or Firm* — NGUYEN TARBET LLC

(57) ABSTRACT

The present invention is directed to devices and methods for assembling particulates through the use of non-contact electrokinetic forces applied to polymeric, organic, non-organic, and metallic micro- and nano-particulates in an aqueous solution. The present invention features an electrode comprising a conductive substrate with a layer of photosensitive polymer disposed on it with a plurality of windows etched into the layer. The plurality of windows expose certain portions of the conductive substrate. Applying electric signals to the conductive substrate (e.g. by a function generator) causes materials to attract to only the exposed portions of the conductive substrate. The materials may comprise a plurality of organic, non-organic, and metallic micro- and nano-particulates disposed in an aqueous solution.

18 Claims, 13 Drawing Sheets
(8 of 13 Drawing Sheet(s) Filed in Color)

GUIDED TEMPLATE BASED ELECTROKINETIC MICROASSEMBLY (TEA)

CROSS-REFERENCES TO RELATED APPLICATIONS

This application is a non-provisional and claims benefit of U.S. Provisional Application No. 63/022,249 filed May 8, 2020, the specification of which is incorporated herein in their entirety by reference.

STATEMENT REGARDING FEDERALLY SPONSORED RESEARCH OR DEVELOPMENT

This invention was made with government support under Grant No. CMMI-1661877 awarded by the National Science Foundation. The government has certain rights in the invention.

FIELD OF THE INVENTION

The present invention is directed to methods for assembling particulates through the use of non-contact electrokinetic forces applied to polymeric, organic, non-organic, and metallic micro- and nano-particulates in an aqueous solution.

BACKGROUND OF THE INVENTION

Assembly of particulates from constitutive parts presently relies on slow serial steps of direct assembly such as pick-and-place operations. Fabrication of many microdevices is limited by the speed, cost, and precision of assembling individual components into predetermined locations. Among available micro-assembly techniques, direct-assembly (also called pick-and-place) and self-assembly play prominent roles. Yet these assembly techniques have significant drawbacks.

Self-assembly refers to the spontaneous assembly and organization of small parts into patterns at the nano- and micro-scale without direct outside intervention. Because self-assembly is designed to operate on a molecular level, it is not suitable for micro-parts and cannot be used to place microscopic and mesoscopic parts into specific locations. Pick-and-place techniques move individual parts via a contact force (such as with micro-grippers or tweezers), or through a non-contact force (for example, using optical tweezers). While positioning with pick-and-place techniques can be fairly accurate, its operation can suffer from reliability of parts' release due to surface adhesion, surface tension, and electrostatic forces. Additionally, pick-and-place systems often rely on expensive robotic systems, and the serial nature of the process means that such an approach requires a long time to assemble a micro-system with many small parts. Finally, the manipulators incorporated in these robotic systems are typically quite large, limiting the portability and miniaturization prospects for such pick-and-place assembly platforms.

Guided electrokinetic assembly that relies on non-contact electrokinetic forces presents a promising alternative to self-assembly and direct-assembly techniques. Dielectrophoresis (DEP) and electroosmosis (EO) have found widespread utilization in transporting, separating, sorting, and assembling nano- and microparticles and cells. However, often due to the presence of forces that are difficult to measure and control (e.g. thermal forces, viscous forces in the fluid, particle-to-particle interactions, etc.), the particle placement using electro-kinetic forces is less accurate than parts placement performed with many pick-and-place systems.

BRIEF SUMMARY OF THE INVENTION

It is an objective of the present invention to provide devices and methods that allow for assembling particulates through the use of non-contact electrokinetic forces applied to organic, non-organic, and metallic micro- and nanoparticulates in an aqueous solution, as specified in the independent claims. Embodiments of the invention are given in the dependent claims. Embodiments of the present invention can be freely combined with each other if they are not mutually exclusive.

The guided non-contact assembly of micro- and nanoparticulates achieved through Template Electrokinetic Assembly (TEA) described in the present invention offers a promising alternative to serial assembly process. The present invention offers electrokinetic dielectrophoretic and electroosmotic assembly of micro- and nanoparticulates onto specific locations on glassy carbon interdigitated electrode arrays (IDEAs). The IDEAs are coated with a layer of lithographically patterned resist. When the AC electric field is applied to the IDEA, the micro- and nanoparticulates suspended in an aqueous solution above the electrodes are attracted to the open regions of the electrodes not covered by the photoresist. As an example of implementation of this invention, the combination of AC electroosmosis and dielectrophoretic forces guides 1 micron and 5 micron diameter polystyrene beads to assemble in wells opened in the photoresist atop the electrodes. Permanent entrapment of the micro- and nanoparticulates is demonstrated via the electropolymerization process of the conducting polymer polypyrrole.

The present invention offers a novel guided micro-assembly technique that combines the speed of self-assembly with the precision of direct assembly techniques. This new technique utilizes a combination of guided dielectrophoresis (DEP) experienced by organic, non-organic, and metallic micro- and nano-particulates and AC electroosmosis (ACEO) experienced by the aqueous solution when an AC electrical signal is applied to the array of glassy carbon microelectrodes. These glassy carbon interdigitated electrode arrays (IDEAs) are coated with a layer of photoresist with lithographically defined windows that expose regions of the carbon electrodes underneath the resist layer. The micro- and nanoparticulates suspended in deionized (DI) water are guided by ACEO and DEP to assemble within these wells on the microelectrodes. Once microparticulates (latex beads in this implementation) are attracted into their predetermined locations on the electrodes, they are permanently attached via the electropolymerization of a thin layer of the conducting polymer polypyrrole (PPy). Because the discussed guided assembly process is not serial in nature, it can be scaled up to achieve simultaneous assembly of a great number of micro- and nanoparticulates.

The present invention additionally features a method for fabricating an electrode for assembling particulates. The method may comprise providing a conductive substrate comprising a silicon wafer with a layer of thermal oxide. The method may further comprise spin-coating a layer of photosensitive polymer over the conductive substrate and soft-baking the layer at a temperature and duration depending on the thickness of the layer. The method may further comprise hard baking the conductive substrate. The method may further comprise etching windows (or wells) in the layer of photosensitive polymer such that the conductive substrate is exposed through the windows. The method may further comprise attaching a function generator to the conductive substrate such that electrical signals may be applied to the conductive substrate.

One of the unique and inventive technical features of the present invention is the use of a layer of photosensitive polymer disposed over a conductive substrate with windows or wells etched into the layer to expose portions of the conductive substrate. Without wishing to limit the invention to any theory or mechanism, it is believed that the technical feature of the present invention advantageously provides for efficient and accurate assembly of particulates or other materials at a specified location on the conductive substrate. None of the presently known prior references or work has the unique inventive technical feature of the present invention. Furthermore, the present invention is counterintuitive. The reason that it is counterintuitive is twofold: (a) the patterned layer of photoresist does not allow the electrical field to pass through and thus the microparticles will assemble only in the specific areas opened in the resist (while prior art teaches that microparticles will be attracted to the random locations of unpatterned electrode); (b) intuition would suggest that attractive electrokinetic forces will gather micro and nano particulates within the windows directly, while our invention teaches the range of techniques and actions to gather the particles within the windows overcoming tendency of microparticles to attach themselves to the edge of resist around the windows.

Furthermore, the present invention allows to use the combination of EO and DEP to sort particulates by size. An essential factor for assembling or sorting the particulates is that the particulates of different sizes experience different effects of EO and DEP. For example, smaller particulates may be collected at the electrode using only EQ. In another embodiment, all particulates may be collected at the electrode using EO, then DEP may be used to attract or repel particulates of a certain size. In yet another embodiment, negative DEP may be used to repel particulates to guide them to the electrode, then positive DEP may be used to attract certain particulates to the electrode.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE SEVERAL VIEWS OF THE DRAWINGS

The patent application or application file contains at least one drawing executed in color. Copies of this patent or patent application publication with color drawings will be provided by the Office upon request and payment of the necessary fee.

The features and advantages of the present invention will become apparent from a consideration of the following detailed description presented in connection with the accompanying drawings in which:

FIG. 7A shows clustering of the 5 μm particulates under the influence of n-DEP forces. FIG. 7B shows schematics of the particulates' motion under p-DEP forces and electro-osmotic (EO) forces that become significant under the low applied frequency. Zone 1 is the local maximum of iDEP forces at the inner edge of the resist well, Zone 2 is the local maximum of iDEP forces around the outer edge of the resist well, whereas Zone 3 is the local maximum for iDEP forces because of clustering of the polystyrene beads inside the wells.

FIG. 8A shows an optical image of the IDEA with the polystyrene beads entrapped by PPy. FIG. 8B shows a scanning electron microscopy (SEM) image of 1 μm bead agglomerate covered with PPy. FIG. 8C shows a close-up of the well with PPy-entrapped 1 μm beads. FIG. 8D shows a close-up of the well with PPy-entrapped 5 μm beads.

DETAILED DESCRIPTION OF THE INVENTION

Figure 1A:
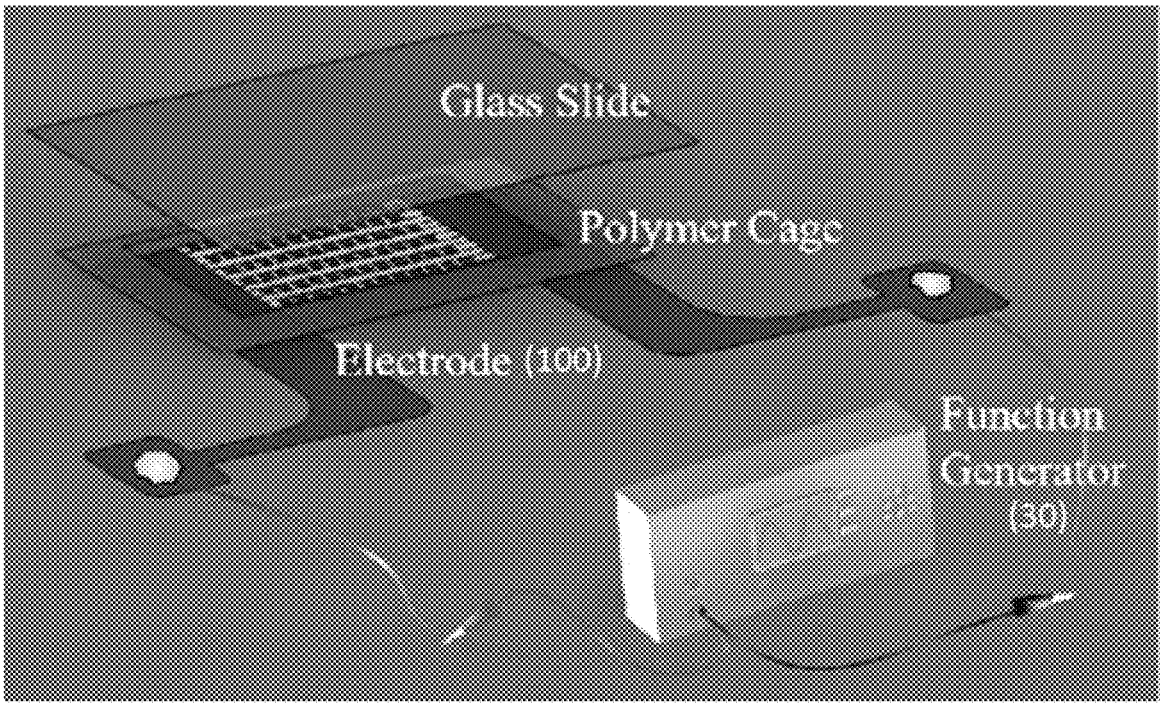
FIG. 1A a schematic of an IDEA chip with a polymer cage created from double-stick tape and covered by a glass slide.

Following is a list of elements corresponding to a particular element referred to herein:

10 conductive substrate
20 layer of photosensitive polymer
25 windows
30 function generator
100 electrode As used herein, the term electroosmosis (EO) refers to the motion of liquid containing the dissolved ions induced by an applied potential across a porous material, capillary tube, membrane, microchannel, or any other fluid conduit. The frequency range within which EO is active is typically between 1 and 10,000 Hz.

As used herein, the term dielectrophoresis (DEP) refers to a phenomenon in which a force is exerted on a dielectric particle when it is subjected to a non-uniform electric field. This force does not require the particle to be charged. All particles exhibit dielectrophoretic activity in the presence of electric fields. However, the strength of the force depends strongly on the medium and particles' electrical properties, on the particles' shape and size, as well as on the frequency of the electric field. Consequently, fields of a particular frequency can manipulate particles with great selectivity. The frequency range for negative DEP and positive DEP highly depends on the nature of the particle and the media. It is typical for polystyrene particles suspended in deionized water to experience positive DEP and lower frequencies than negative DEP.

As used herein, the term "function generator" refers to a piece of electronic test equipment or software used to generate different types of electrical waveforms over a wide range of frequencies. Non-limiting examples of electrical waveforms include sine waves, square waves, triangular waves, or sawtooth waves. The waveforms may be repetitive or single-shot.

Figure 1B:
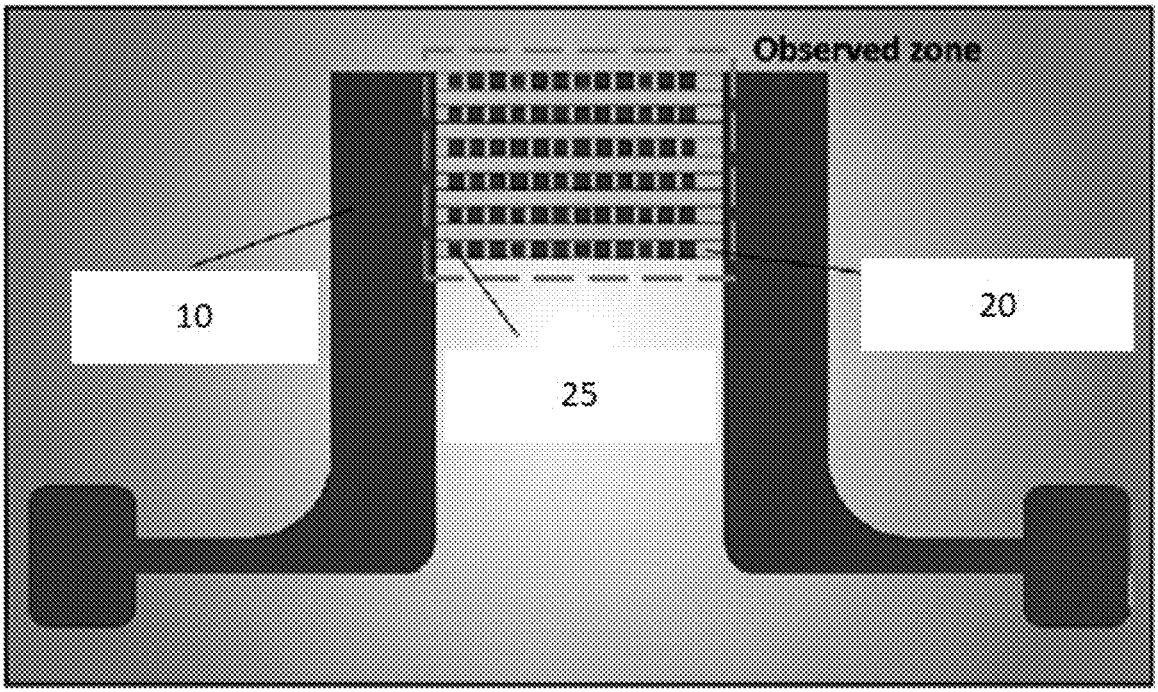
FIG. 1B shows a sketch of interdigitated electrode arrays.
Figure 1C:
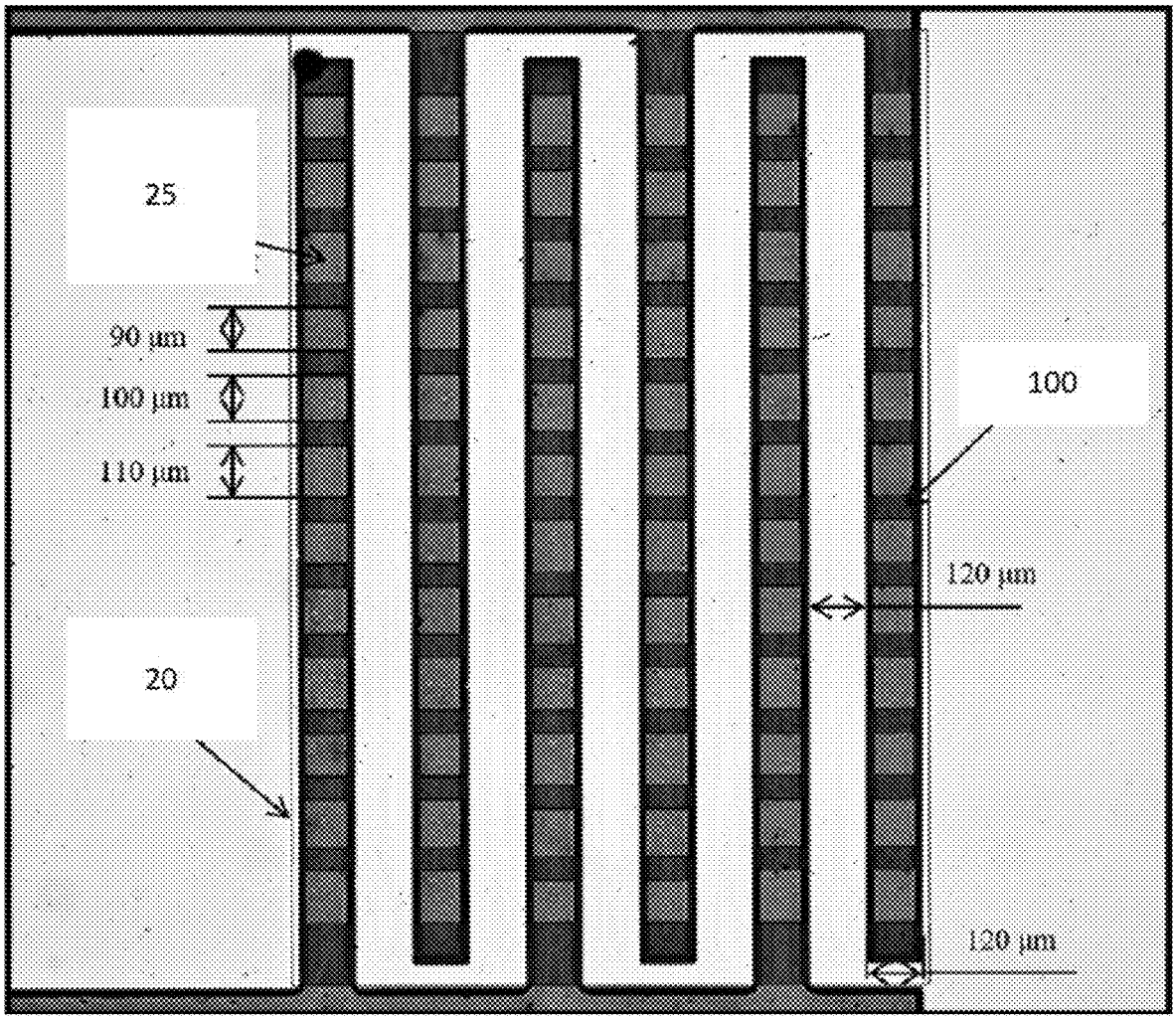
FIG. 1C shows an optical micrograph of electrode fingers covered with square wells opened in photoresist.

Referring now to FIGS. 1A-1C, the present invention features a system for assembling particulates through the use of electrokinetic means. The system may comprise a conductive substrate (10), a layer of photosensitive polymer (20) disposed over the conductive substrate (10), and a function generator (30). The layer of photosensitive polymer (20) may be patterned with a plurality of windows (25) exposing the conductive substrate (10). In some embodiments, the layer of photosensitive polymer (20) has a single window (25). The system may further comprise a solution comprising a plurality of particulates, and the solution may contact the layer of photosensitive polymer (20) and the conductive substrate (10). In some embodiments, the solution may be an aqueous solution.

In some embodiments, the function generator (30) is configured to apply an AC signal to the conductive substrate (10). Applying an AC signal to the conductive substrate (10) may cause the plurality of particulates in the solution to move and attach to the conductive substrate (10) through the plurality of windows (25) in the layer of photosensitive polymer (20). In some embodiments, the AC signal is configured to cause electroosmosis or dielectrophoresis. In other embodiments, the system is configured to use a combination of electroosmosis and dielectrophoresis to guide the plurality of particles to the conductive substrate.

Non-limiting examples of the conductive substrate (10) include regions of doped silicon wafer, layers of polysilicon, traces of gold, silver, or copper, and a layer of pyrolyzed carbon. Examples of the photosensitive polymer (20) include, but are not limited to, SU-8 photoresist, Shipley or AZ resist lines and others, dry resin, or any non-conductive layer such as cardboard or tape with windows cut in these layers could be utilized. In other embodiments, the solution may comprise organic, non-organic, metallic particulates, or a combination thereof. In further embodiments, the particulates may be microparticulates, nanoparticulates, or a combination thereof. Non-limiting examples of the particulates include organic molecules, carbon nanotubes, cells, inorganic silicone chips, or polysilicone microparticles. In some embodiments, the solution may comprise carboxyl modified latex polystyrene beads in deionized water.

In further embodiments, the system may combine particle assembly and sorting. The particulates whose physical properties such as electrical conductivity and permeability are affected by particle size and material composition will experience positive and negative DEP at different ranges of frequencies. Thus it is possible to select a specific frequency range when one type of particle will experience positive DEP, while another type of particle will experience negative DEP and therefore, only the particles experiencing the positive DEP will be assembled at the electrodes. In this embodiment, the plurality of particulates may be guided to the conductive substrate (10) using a combination of electroosmosis and dielectrophoresis. The combination of AC electroosmosis (EO) and dielectrophoretic (DEP) forces applied at certain frequencies may sort the particulates. As a non-limiting example, the particulates may settle in the aqueous solution to bring the particulates closer to the conductive substrate (10). EO may be used to bring all particulates in the aqueous solution closer to the conductive substrate (10). All of the particulates may be collected at the conductive substrate (10) using only EO. In other embodiments, most of the particulates may be collected at the conductive substrate (10) using EO, then by using negative DEP to collect the remaining particulates. In some embodiments, for larger particulates, negative DEP may be used to repel the particulates to a region of the conductive substrate (10), then positive DEP may be used to attract the particulates to the conductive substrate. In yet another embodiment, smaller particulates may be attracted to the conductive substrate (10) by using EO only. Examples of properties that may be used to sort the particulates include, but are not limited to, size, shape, density, material composition, permeability, or conductivity.

As a non-limiting example, when 1 μm and 5 μm diameter polystyrene beads were used, at an applied frequency of 1 kHz, 1 micron beads were quickly gathered inside the wells under positive DEP conditions. However, when the identical conditions were used on 5 micron microbead suspension placed onto electrode arrays, most of the microbeads would not move towards the wells. Without wishing to limit the present invention to any theory or mechanism, the viscous drag for larger 5 micron beads may be significantly greater than that for smaller 1 micron beads, as seen from Stokes law describing the viscous drag that is experienced by spherical particles of radius moving through the media.

Figure 9:
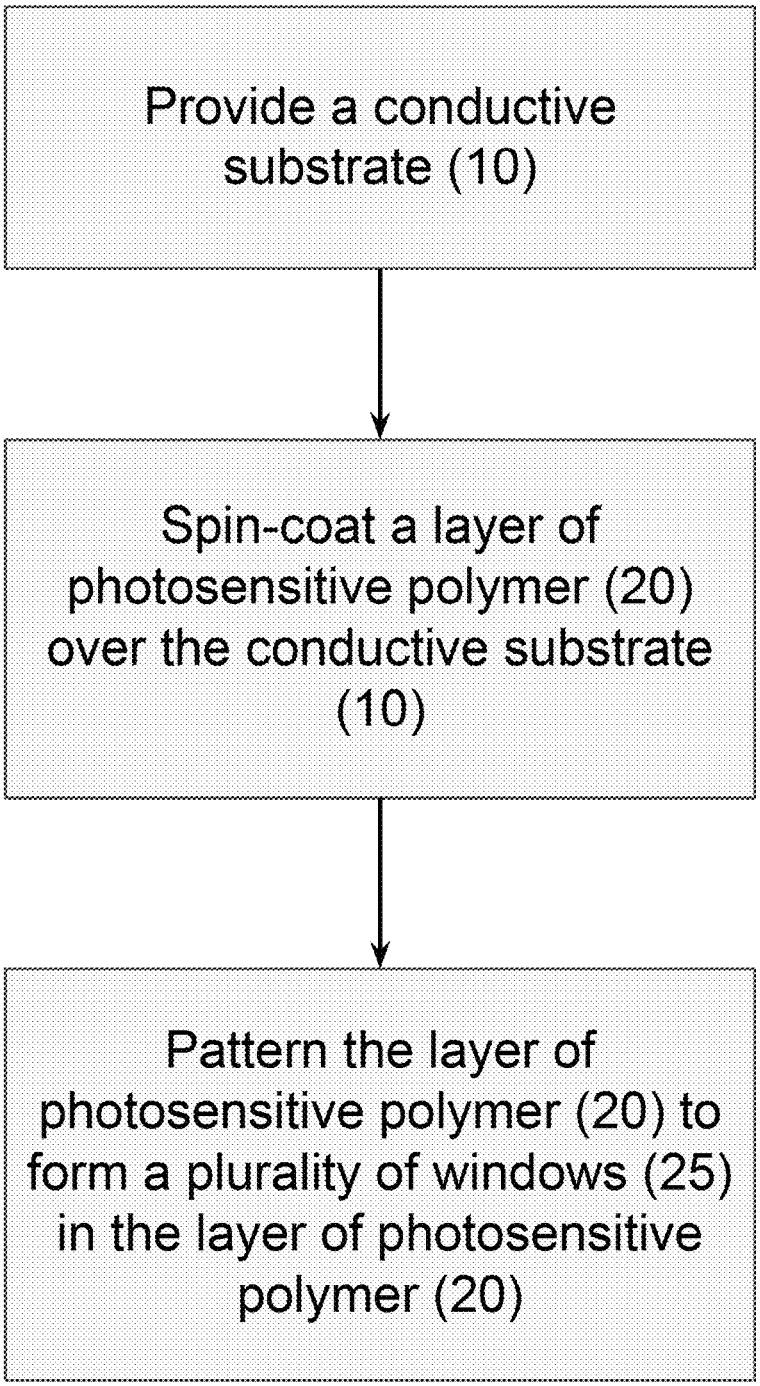
FIG. 9 shows a flow chart of a method for fabricating an electrode of the present invention.

Referring now to FIG. 9, the present invention features a method for fabricating an electrode (100) used for assembling particulates through the use of electrokinetic means. The method may comprise providing a conductive substrate (10) and spin-coating a layer of photosensitive polymer (20) over the conductive substrate (10). The method may further comprise patterning the layer of photosensitive polymer (20) to form a plurality of windows (25) in the layer of photosensitive polymer (20). The plurality of windows (25) may expose the conductive substrate (10) underneath. In other embodiments, a single window is made on the photosensitive polymer (20) to expose the conductive substrate (10) underneath.

In some embodiments, the conductive substrate (10) may comprise a silicon wafer covered with a layer of thermal oxide. Other non-limiting examples of the conductive substrate (10) include regions of doped silicon wafer, layers of polysilicon, traces of gold, silver, or copper, and a layer of pyrolyzed carbon. Examples of the photosensitive polymer (20) include, but are not limited to, SU-8 photoresist, Shipley or AZ resist lines and others, dry resin, or any non-conductive layer such as cardboard or tape with windows cut in these layers could be utilized. The method may further comprise soft baking the layer of photosensitive polymer (20) after spin-coating it onto the conductive substrate (10). The method may further comprise hard baking the conductive substrate (10) after soft baking the layer of photosensitive polymer (20). In some embodiments, the electrode (100) is connected to a function generator (30). The function generator (30) may be configured to generate electric signals to attract particulates in a solution to the conductive substrate (10) through the plurality of windows (25).

Figure 10:
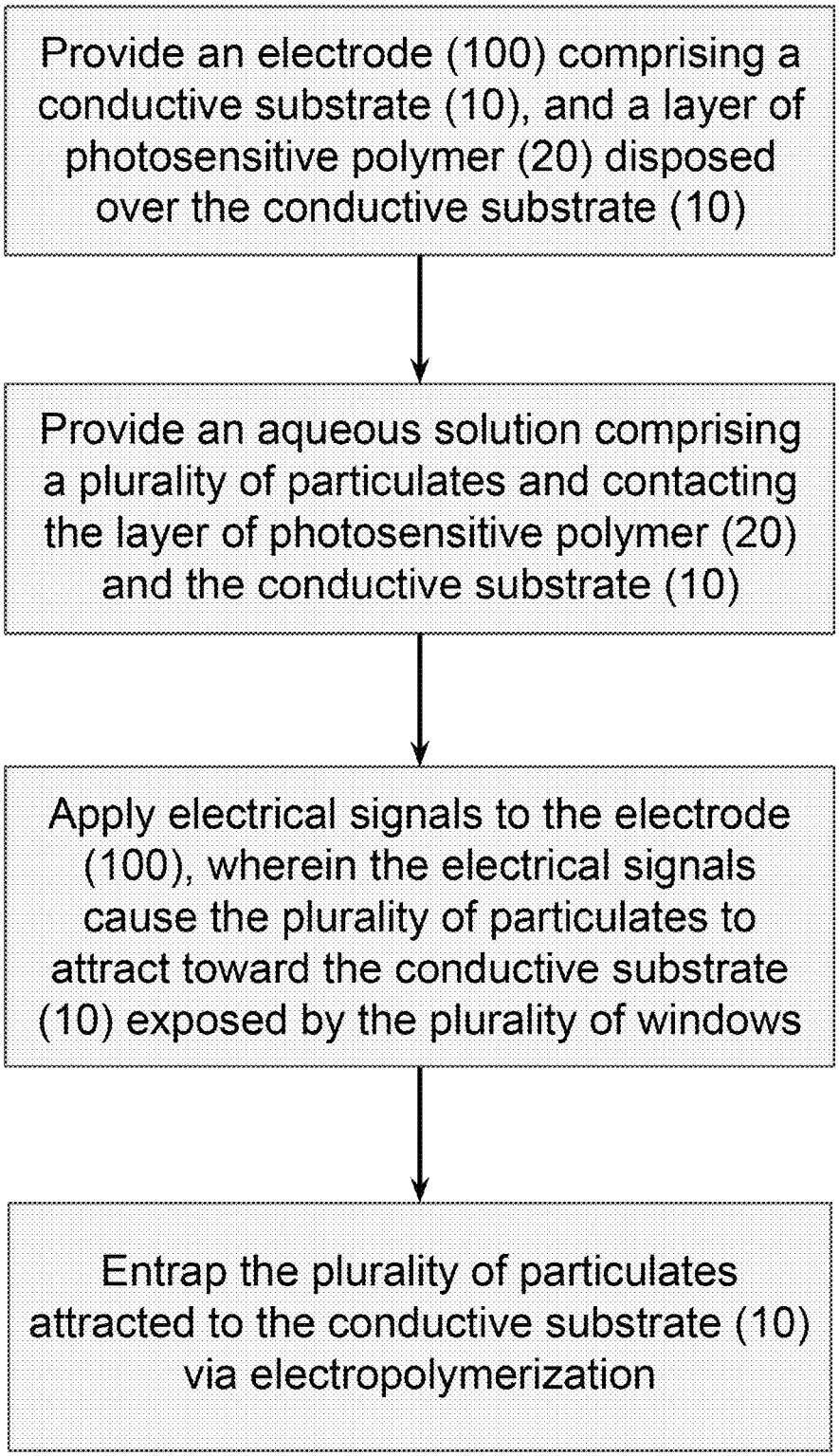
FIG. 10 shows a flow chart of a method for assembling microdevices using electrokinetic means.

Referring now to FIG. 10, the present invention features a method for assembling particulates through the use of electrokinetic means. The method may comprise: providing an electrode (100) comprising a conductive substrate (10) and a layer of photosensitive polymer (20) disposed over the conductive substrate (10). The layer of photosensitive polymer (20) may be patterned with a plurality of windows (25) exposing the conductive substrate (10). In other embodiments, the photosensitive polymer (20) may only have one window to expose the conductive substrate (10). The method may further comprise providing a solution comprising a plurality of particulates, and the solution contacts the layer of photosensitive polymer (20) and the conductive substrate (10). In some embodiments, the solution may be an aqueous solution. The method may further comprise applying electrical signals to the electrode (100). The electrical signals may cause the plurality of particulates to attract towards the conductive substrate (10) exposed by the plurality of windows (25). The method may further comprise entrapping the plurality of particulates attracted to the conductive substrate (10) via electropolymerization.

In some embodiments, the conductive substrate (10) may comprise a silicon wafer covered with a layer of thermal oxide. Other non-limiting examples of the conductive substrate (10) include regions of doped silicon wafer, layers of polysilicon, traces of gold, silver, or copper, and a layer of pyrolyzed carbon. Examples of the photosensitive polymer (20) include, but are not limited to, SU-8 photoresist, Shipley or AZ resist lines and others, dry resin, or any non-conductive layer such as cardboard or tape with windows cut in these layers could be utilized. In some embodiments, the solution may comprise carboxyl modified latex polystyrene beads in deionized water. In some embodiments, the electrical signals may be applied by a function generator (30).

The electropolymerization may comprise providing a polymerization solution, mixing the solution with a particulate suspension, depositing the solution and the particulate suspension over the electrode, covering the electrode, and applying a DC offset to the electrode (100) to entrap the plurality of particulates in place. In some embodiments, the polymerization solution may comprise a polymerization monomer and an ionic surfactant. Examples of polymerization monomers include, but are not limited to, pyrrole or aniline. A non-limiting example of an ionic surfactant is NaDBS.

The plurality of particulates may comprise organic particulates, non-organic particulates, and metallic particulates. In other embodiments, the particulates may be microparticulates, nanoparticulates, or a combination thereof. In some embodiments, the method may sort the particulates by a certain property of the particulates. Examples of properties that may be used to sort the particulates include, but are not limited to, size, shape, density, material composition, permeability, or conductivity. In preferred embodiments, the particulates are guided to the conductive substrate (10) by a combination of electroosmosis and dielectrophoresis.

Assembly of particulates from constitutive parts presently relies on slow serial steps of direct assembly such as pick-and-place operations. The guided non-contact assembly of microparticulates achieved through Template Electrokinetic Assembly (TEA) described in this work presents a promising alternative to serial assembly process. This work studies an electrokinetic dielectrophoretic and electroosmotic assembly of polymer microparticulates onto specific locations on glassy carbon interdigitated electrode arrays (IDEAs). The IDEAs are coated with a layer of lithographically patterned resist. When the AC electric field is applied to the IDEA, the microparticulates suspended in an aqueous solution above the electrodes are attracted to the open regions of the electrodes not covered by the photoresist. The combination of AC electroosmosis and dielectrophoretic forces guide 1 μm and 5 μm diameter microparticulates to assemble in wells opened in the photoresist atop the electrodes. Permanent entrapment of the microparticulates is demonstrated via the electropolymerization process of the conducting polymer polypyrrole.

EXAMPLE

The following is a non-limiting example of the present invention. It is to be understood that said example is not intended to limit the present invention in any way. Equivalents or substitutes are within the scope of the present invention.

Figure 2A:
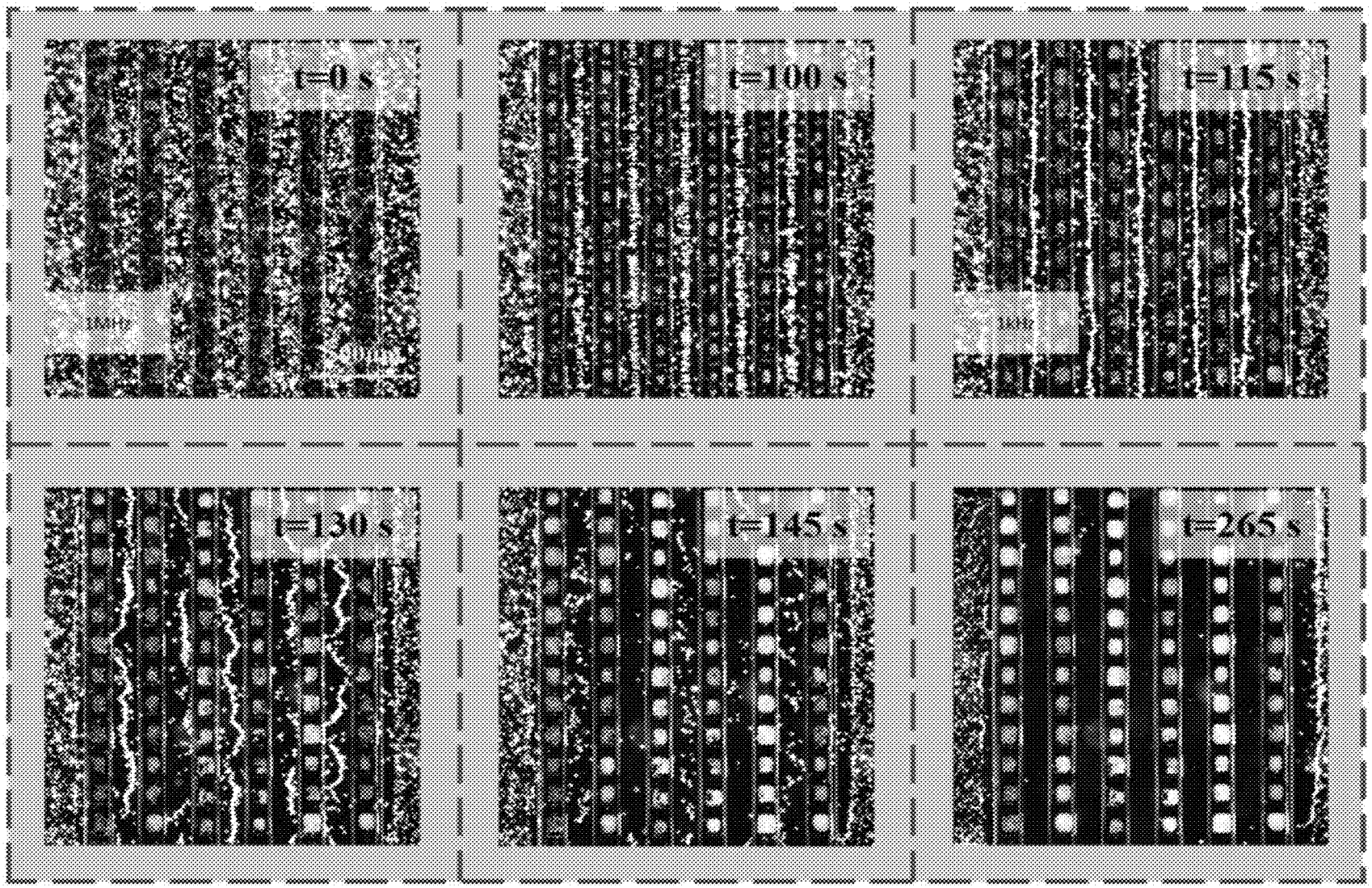
FIG. 2A shows a process of template electrokinetic assembly (TEA) of 5 μm polystyrene microbeads.
Figure 2B:
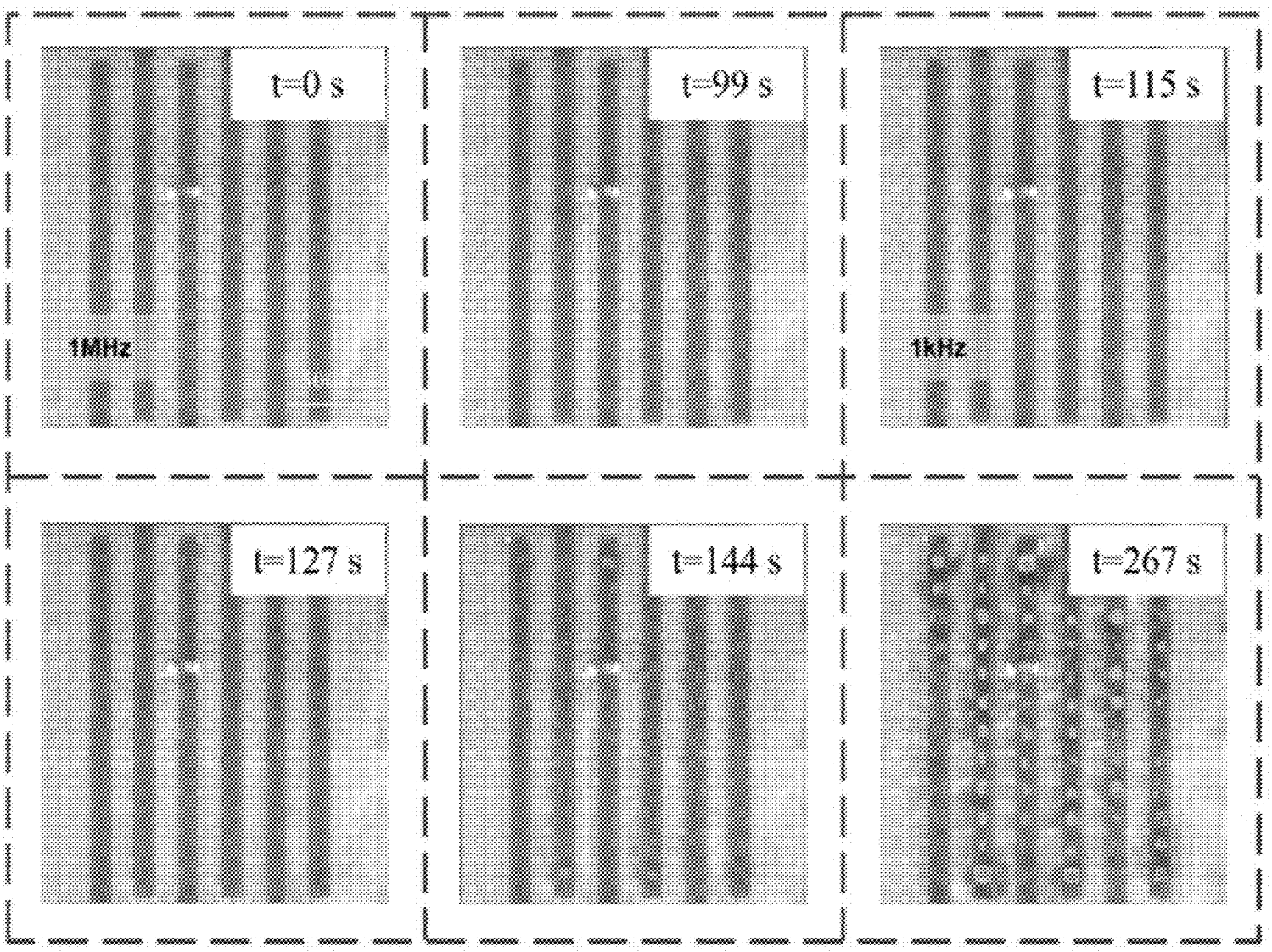
FIG. 2B shows a process of TEA of 1 μm polystyrene microbeads.

The goal of the Template Electrokinetic Assembly (TEA) process under study is to collect 1 micron and 5 micron polystyrene microbeads into specific locations, so-called "wells," the windows opened in the photoresist layer on top of microelectrodes as seen in FIGS. 1A-1C within the positive DEP regime, such as at an applied frequency of 1 kHz, 1 micron beads were quickly gathered inside the wells under positive DEP conditions (FIG. 2). However, when the identical conditions were used on 5 micron microbead suspension placed onto electrode arrays, most of the microbeads would not move towards the wells. This can be explained by the fact that the viscous drag for larger 5 micron beads is significantly greater than that for smaller 1 micron beads, as seen from Stokes law describing the viscous drag that is experienced by spherical particles of radius moving through the media.

Figure 3A:
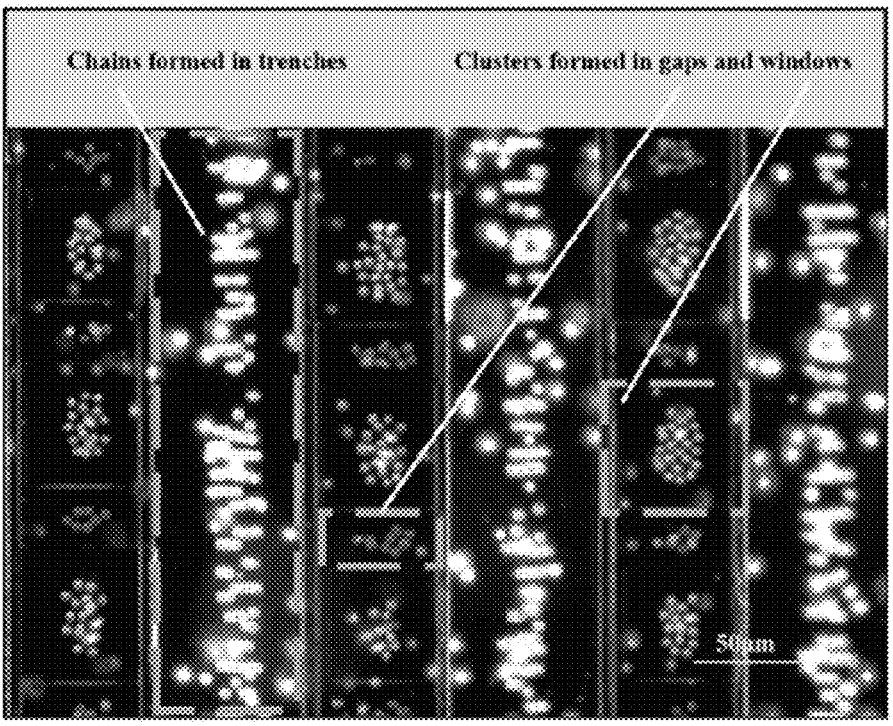
FIG. 3A shows patterns formed by 5 μm particles under the effect of nDEP under 1 MHz 4 Vpp AC bias.

To minimize the drag experienced by the 5 micron particles during the micro-assembly, a two-step process is implemented. In the first step, negative DEP is applied to the beads using 1 MHz applied frequency and 4 Vpp (peak-to-peak). Under these conditions, the initially homogeneous suspension of 5 m particles is forced into three areas: the trenches between the electrodes, the gaps between the wells (i.e. windows opened in the photoresist), and the centers of the wells as seen in FIG. 3A. While this pattern was observed for all experiments with 5 micron beads during the described nDEP step, the 1 m particle suspension under the same conditions remained homogeneously dispersed throughout the medium. The larger 5 micron beads particles tend to settle down gravitationally to the level of the electrodes in a few minutes after the particle suspension is placed onto the electrodes, while 1 micron beads remain suspended above the electrodes where negative (i.e. repulsive) DEP force does not push beads into specific regions, but rather repels them away from the surface of the electrodes.

Once the nDEP step was performed, the frequency was lowered to 1 kHz where the beads experience a positive DEP. At this point, the 5 micron particles located in the trenches and gaps moved towards the edges of the electrodes and were subsequently pulled into the centers of the wells, joining the cluster of particles initially located there, as the sequence of pictures in FIG. 2 demonstrates. Comparing the kinematics of motion of the 1 and 5 micron beads under the influence of positive DEP, one can observe that the 1 micron particles were propelled from the bulk of the medium towards the wells at velocities higher than that of 5 micron beads likely due to the lower drag of the smaller particles.

Figure 3B:
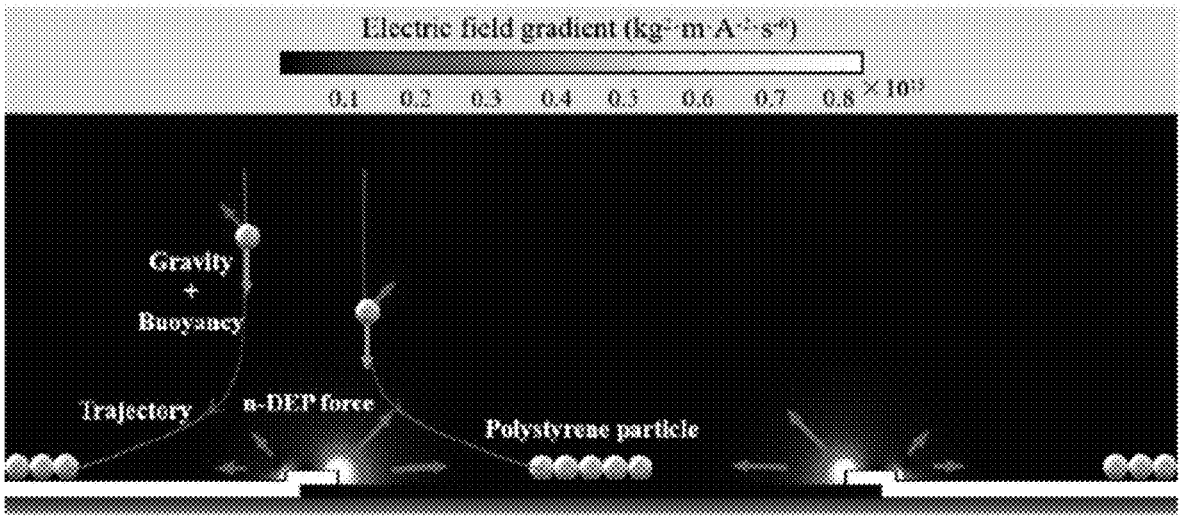
FIG. 3B shows Comsol multiphysics simulation results reflecting the combination of gravitational sedimentation and nDEP on polystyrene beads, explaining the formation of the observed initial bead pattern.

The formation of the initial nDEP pattern of 5 micron beads can be explained by the fact that the electric field lines are concentrated around dielectrics and insulators in a process called insulator DEP (iDEP). Therefore, strong negative DEP forces will be produced around the photoresist edges that cover the electrodes. Some 5 micron beads will settle to the bottom of the electrode chip, including into the wells. Once nDEP is applied, the beads already located inside the wells will be pushed together into the center of each well away from the well sides, while beads between the wells (on top of the resist) will be pushed away by this nDEP force forming the lines in the gaps between wells, and similarly the beads will be pushed away from the resist-covered edges of the electrodes, forming the lines in the trenches between the electrodes as seen in FIG. 3A. Influence of negative DEP forces on the beads can be demonstrated by the results of the Comsol Multiphysics simulation in FIG. 3B.

Figure 4A:
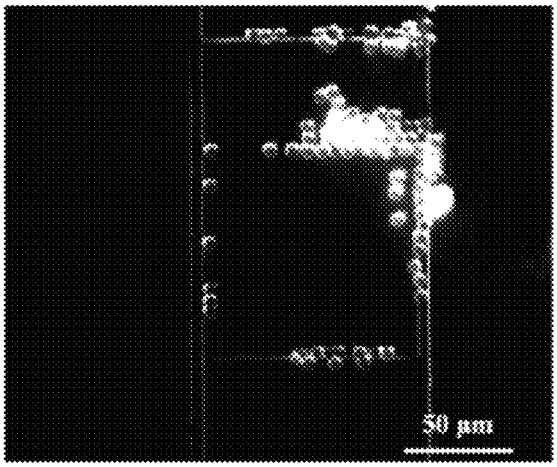
FIGS. 4A-4B show positive iDEP from the edges of the well attracting 5 μm polystyrene beads at 1 kHz and 3 Vpp.
Figure 4B:
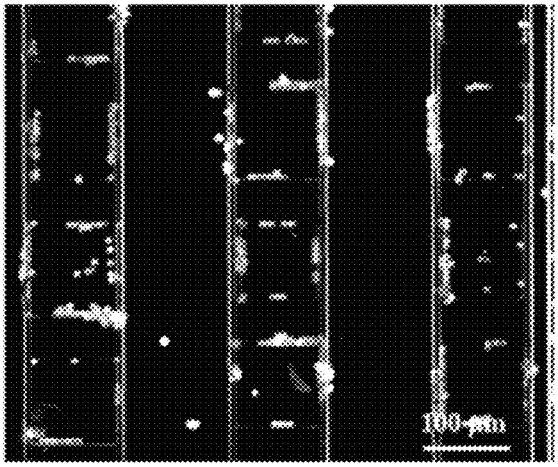
Figure 4C:
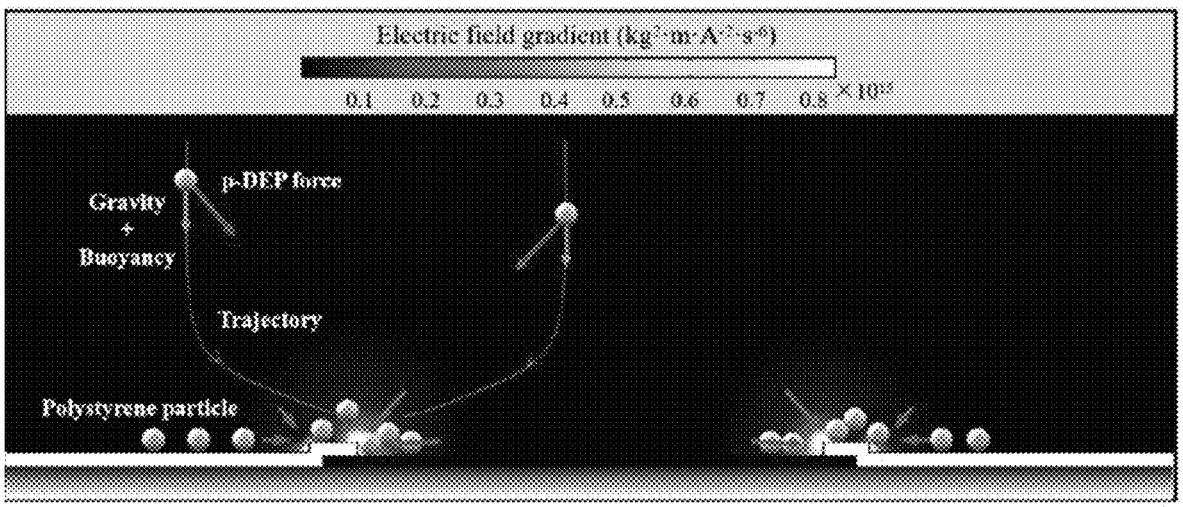
FIG. 4C shows results of Comsol simulations demonstrating that under positive DEP, the beads will move towards the photoresist edges around the windows that have the highest electric field gradient.

When the applied frequency is lowered to 1 kHz and the microbeads start to experience positive DEP, the edges of the resist and the growing clusters of microbeads inside the wells serve as the points of the highest electric field gradient and subsequently as the areas of microbead assembly. From the sequence of pictures in FIG. 2, it can be seen that the positive iDEP forces near the edges of the wells begin attracting the particles previously positioned in the gaps between wells. Simultaneously, pearl chains in the trenches between the electrodes are being attracted by the outer sides of the wells where they eventually reposition themselves, since the resist edges of the windows are the areas of the high electric field gradient and consequently serve are regions of attraction of the microbeads as demonstrated by the optical micrographs and Multiphysics simulation results presented in FIG. 4.

Figure 5:
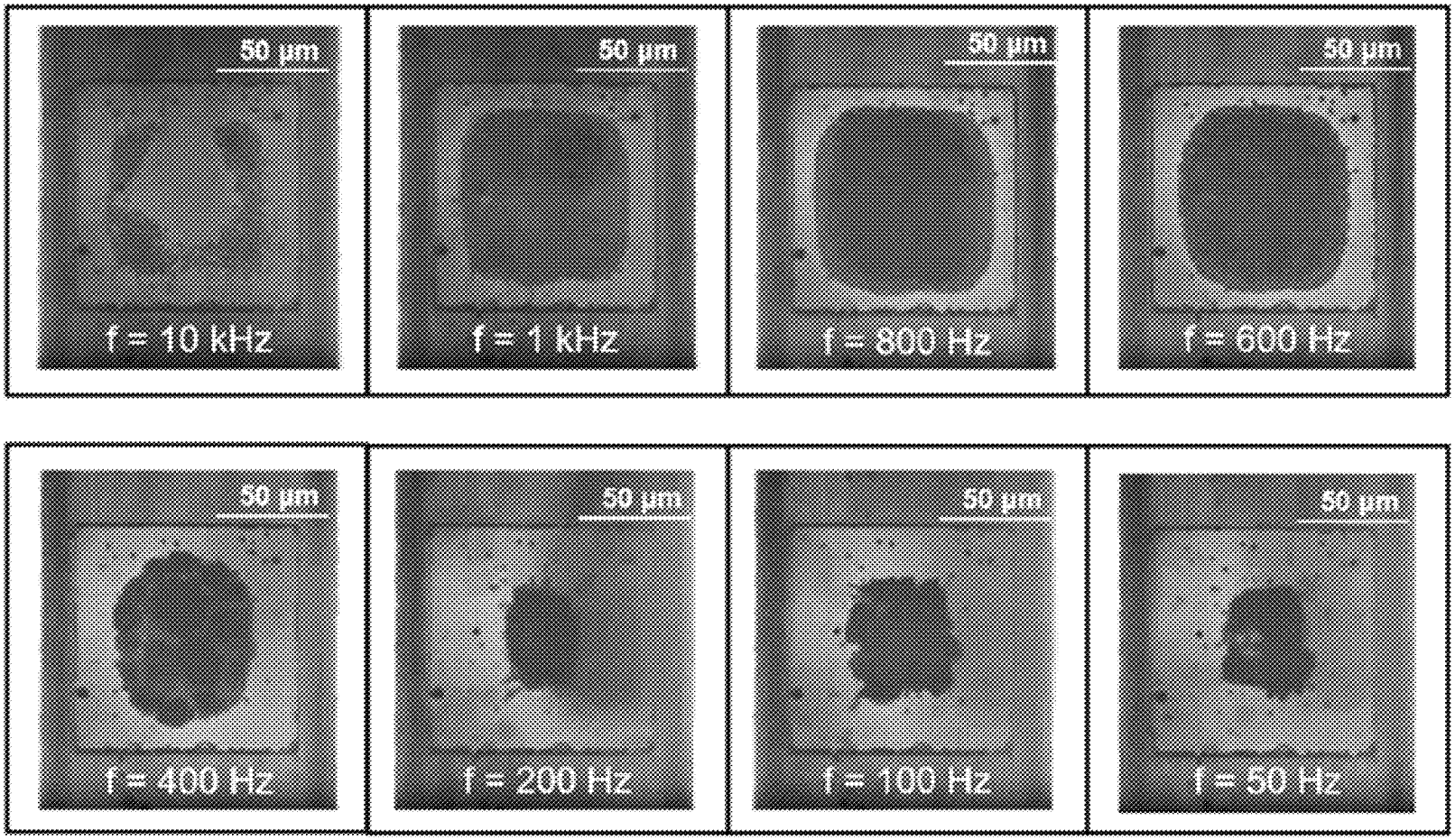
FIG. 5 shows 1 μm polystyrene beads pushed together under the influence of electroosmosis inside wells at 3 Vpp as the applied frequency is decreased from 10 kHz to 50 Hz.

For 1 micron beads, the DEP force is too weak due to the beads' small size to be comparable to the ACEO flow, and consequently the beads can act as tracers to reveal the nature of the ACEO flow. It has been proven in other works that electroosmosis-driven vortices are induced at the edges of coplanar bar electrodes as well as over the surface of the electrodes. For the patterned electrodes, these EO vortices are generated above the wells at frequencies of 10 kHz and lower where EO is strong. FIG. 5 demonstrates the frequency dependence of the size of ACEO flow vortices. Generally, the vortices expanded (from the edges of the wells towards their centers) with decreasing frequency and thus pushed the beads inside the wells closer together.

Figure 6A:
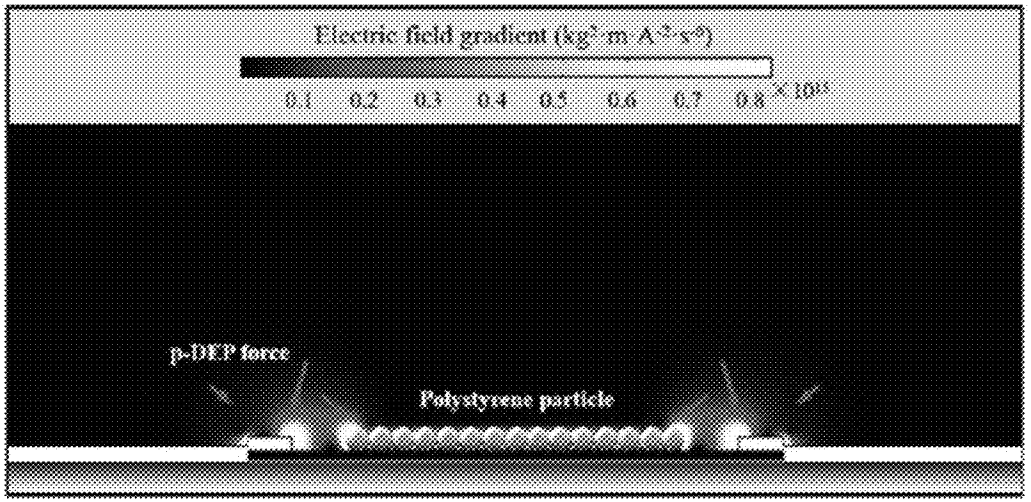
FIG. 6A shows a Comsol simulation result demonstrating two areas of high electric field gradients around edges of resist windows and around a particle cluster inside the window.
Figure 6B:
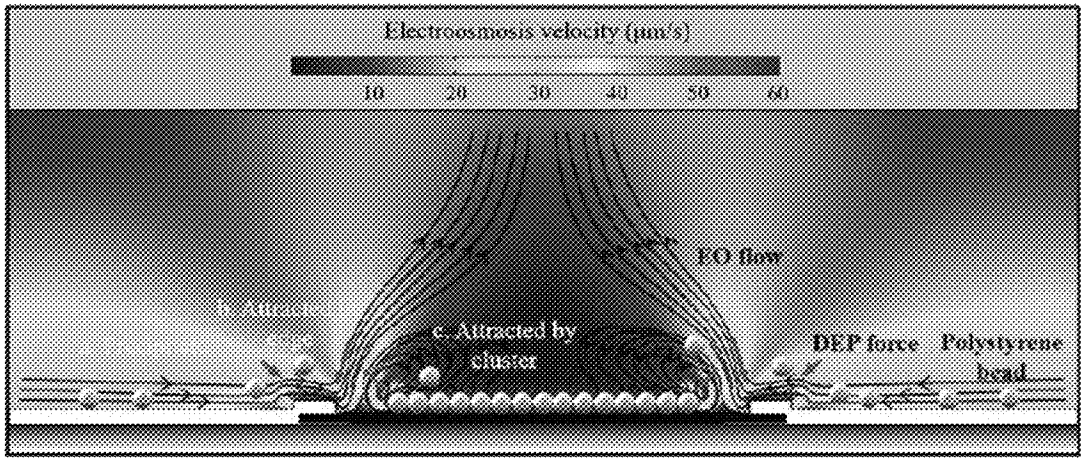
FIG. 6B shows a series of optical micrographs tracing the movement of 5 micron beads towards the cluster of 5 micron beads inside the well under 1 kHz 3 Vpp bias.
Figure 6C:
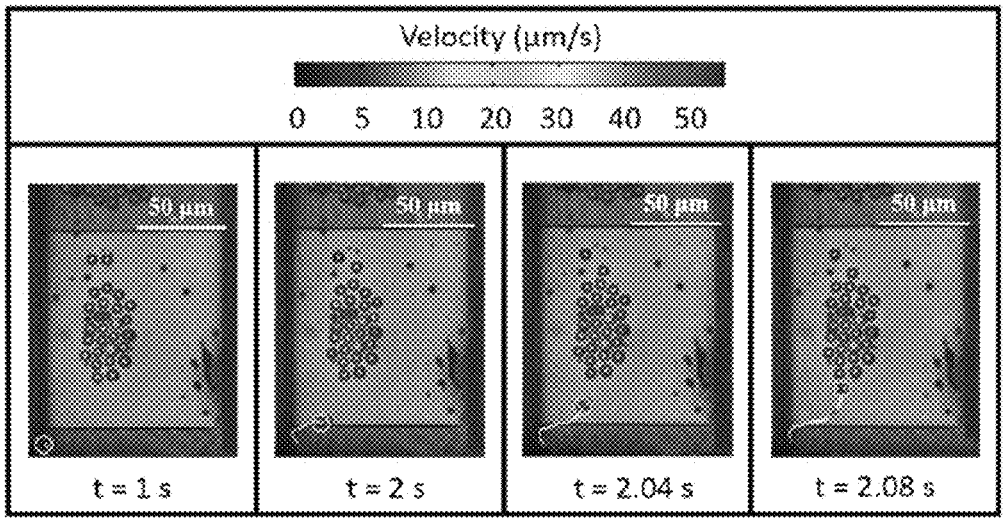
FIG. 6C shows a Comsol model of EO streamlines around the resist window.

1 micron beads influenced by electroosmotic flow will fill the windows if the applied frequency is below 10 kHz. Meanwhile, 5 micron beads under that range of frequencies will aggregate at the edges of the windows under the influence of the positive iDEP forces, rather than in the windows since larger beads are more inertial and less influenced by the flow streamlines and more influenced by DEP forces that depend on the cube of particle radius. FIG. 6A presents a Comsol simulation of iDEP forces for the situation when there is a cluster of beads inside the window already. In this case, there will be a competing pDEP influence between the cluster of the beads inside the window and the resist edge of the window (both areas of high electric field gradient). FIG. 6B demonstrates the movement of the 5 micron beads towards the growing cluster of 5 micron beads inside the wells. The movement of the beads from the edge towards the center of the wells is assisted by the electroosmotic flow whose streamlines are simulated in FIG. 6C.

Thus, in order to fill the windows in the resist with 5 micron beads, deposit the bead suspension, wait several minutes for gravitational sedimentation to take place and then apply 1 MHz frequency to utilize negative DEP (FIG. 2). This initial step ensures that some beads will already be inside the windows. Following that nDEP step with lowering frequency to 1 kHz to start positive DEP results in filling the windows with 5 micron beads as seen in FIG. 3A.

Figure 6D:
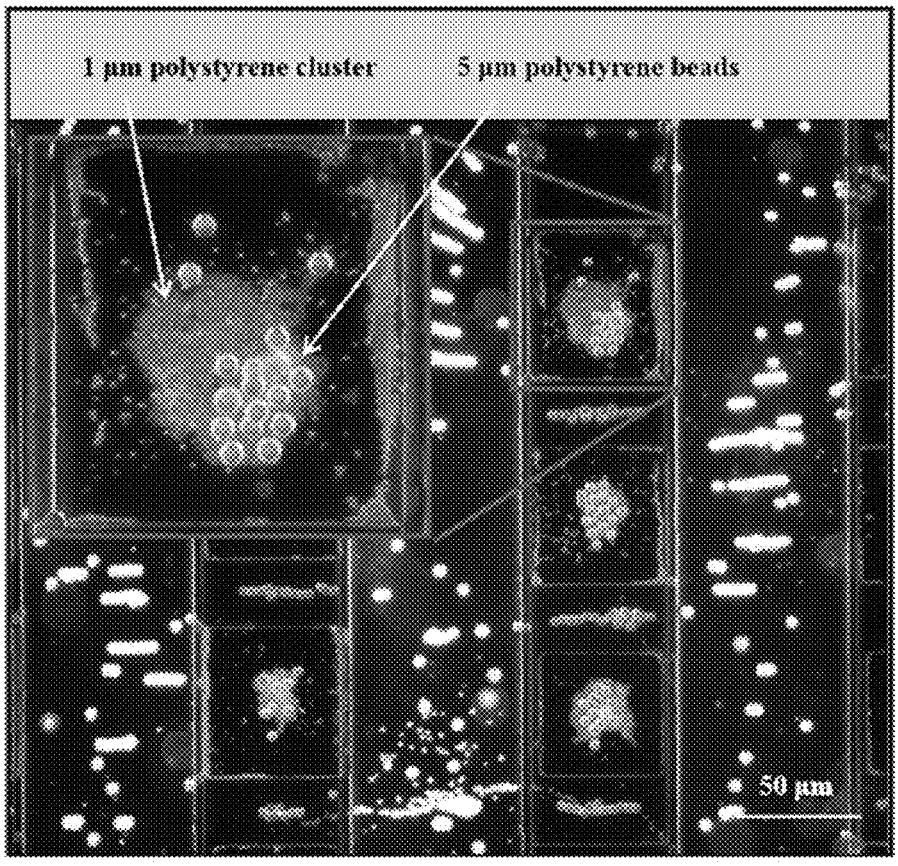
FIG. 6D shows attraction of 5 μm particles by the cluster of 1 μm particles inside the wells.

An alternative strategy exists for attracting 5 micron beads into the windows if a homogeneous suspension of beads is used and gravitational sedimentation isn't utilized. Adding 1 micron beads to the suspension of 5 micron beads and applying 1 kHz frequency, causes the 1 micron beads to start filling the windows under the influence of ACEO. The clusters of these 1 micron beads serve as areas of the high electric field and will cause positive DEP for 5 micron beads. FIG. 6D illustrates that 5 micron beads can be dragged into a cluster of 1 m particles by means of positive iDEP attraction.

Figure 7A:
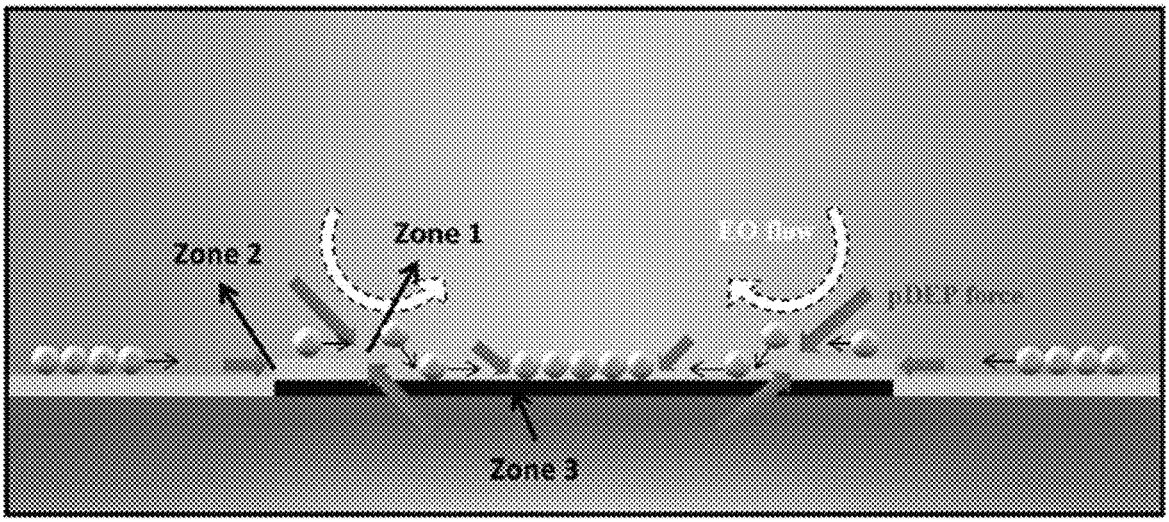
FIGS. 7A-7B show the mechanism of the guided electrokinetic assembly for 5 μm microparticles. The schematics represents a cross-section of the IDEA chip where the carbon electrodes are black, resist is gray, and the DEP forces are represented by red arrows and electro-osmotic forces by blue arrows.
Figure 7B:
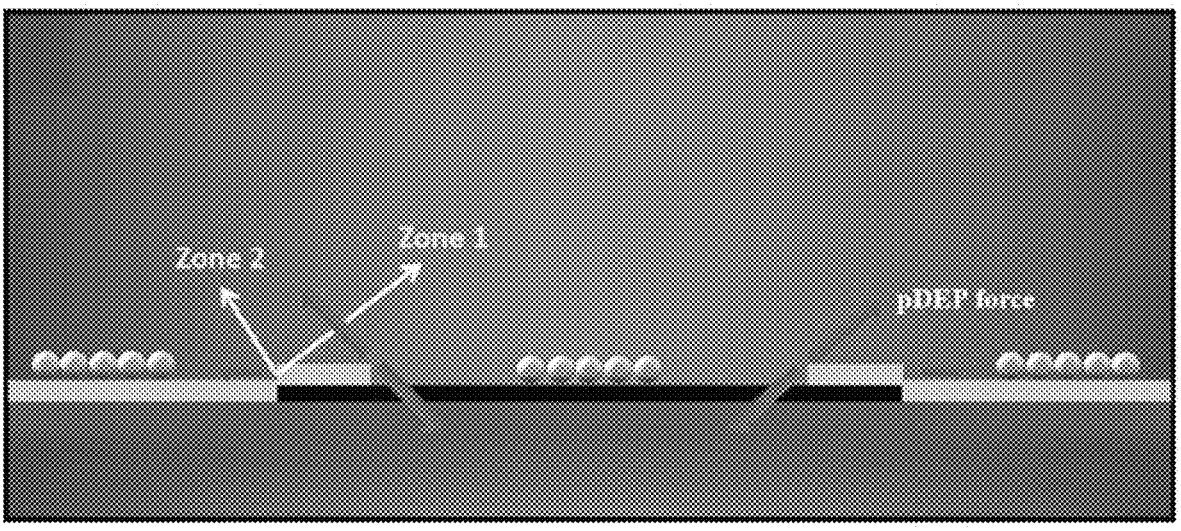
Figure 8A:
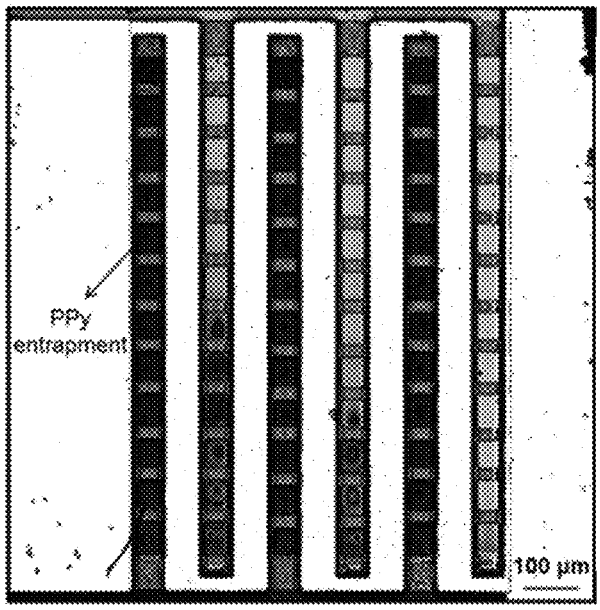
FIGS. 8A-8D show the entrapment of beads by PPy deposition.
Figure 8B:
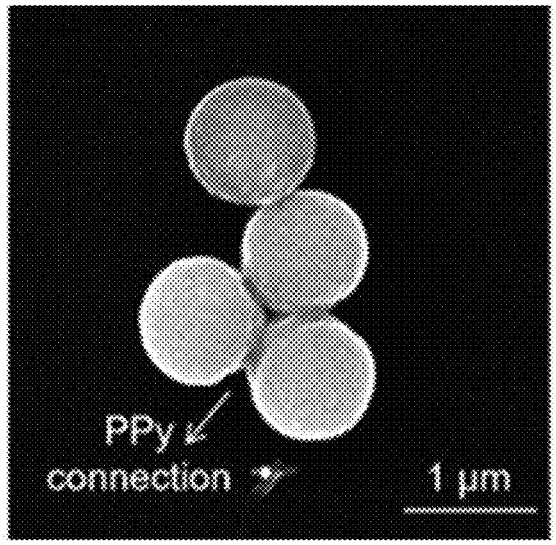
Figure 8C:
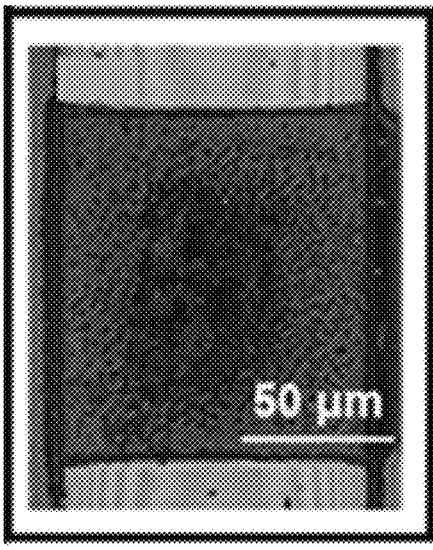
Figure 8D:
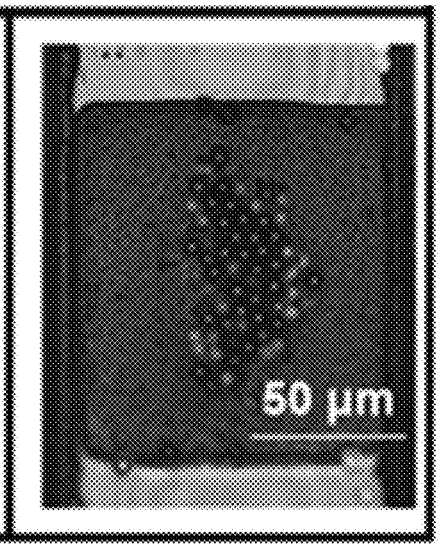

FIG. 7 summarizes the interplay of the DEP and EO forces for 5 micron beads in the Template Electrokinetic Assembly (TEA) process.

The guided electrokinetic microassembly of polystyrene microparticles onto specific locations of patterned carbon microelectrodes was presented. The assembly sequence is divided into two steps: guided deposition of microparticles, followed by their permanent entrapment via electropolymerization of the conductive polymer, polypyrrole. Experimental evidence and numerical simulations presented demonstrate the process of the guided assembly of microparticles under the combined influence of dielectrophoretic and electroosmotic forces. The demonstrated guided electrokinetic assembly technique has the potential to be utilized for massively parallel micro-assembly processes for devices employed in a wide range of fields from biotechnology to micro- and nano-electronics and with microparts to be assembled made out of a variety of materials such as organic matter, dielectric, insulators, or metals.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting essentially of" or "consisting of", and as such the written description requirement for claiming one or more embodiments of the present invention using the phrase "consisting essentially of" or "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A system for assembling particulates through the use of electrokinetic means, the system comprising:

a. a conductive substrate (10) comprising a plurality of electrodes disposed side-by-side, each electrode comprising;

a layer of photosensitive polymer (20) disposed on top of each electrode;

wherein each layer of photosensitive polymer (20) is patterned with a plurality of windows (25) exposing the electrode underneath;

wherein, for each electrode, a bottom of each window of the plurality of windows (25) is made up entirely of the electrode;

c. a solution comprising a plurality of particulates and contacting the conductive substrate; and d. a function generator (30) configured to apply a non-uniform AC signal to the plurality of electrodes such that the non-uniform AC signal causes the plurality of particulates in the solution to move and attach to the plurality of electrodes through the plurality of windows (25).

2. The system of claim 1, wherein the AC signal is configured to cause electroosmosis or dielectrophoresis.

3. The system of claim 2, wherein the system is configured to use a combination of electroosmosis and dielectrophoresis to guide the plurality of particles to the plurality of electrodes.

4. The system of claim 1, wherein the particulates are microparticulates, nanoparticulates, or a combination thereof.

5. The system of claim 1, wherein the particulates are organic particulates, non-organic particulates, metallic particulates, or a combination thereof.

6. The system of claim 1, wherein the system is configured to sort the plurality of particulates based on size, shape, density, conductivity, material composition, or permeability.

7. A method for fabricating an electrode array (100) used for assembling particulates through the use of electrokinetic means, the method comprising:

a. providing a conductive substrate (10) comprising a plurality of electrodes disposed side-by-side;

b. spin-coating a layer of photosensitive polymer (20) on top of each electrode of the plurality of electrodes; and c. patterning each layer of photosensitive polymer (20) to form a plurality of windows (25) in each layer of photosensitive polymer (20) and expose the electrode underneath;

wherein, for each electrode, a bottom of each window of the plurality of windows (25) is made up entirely of the electrode;

wherein each electrode (100) is connected to a function generator (30), wherein the function generator (30) is configured to generate non-uniform electric signals to attract particulates in a solution to the plurality of electrodes through the plurality of windows (25).

8. The method of claim 7 further comprising soft baking each layer of photosensitive polymer (20) after spin-coating it onto the electrode.

9. The method of claim 8 further comprising hard baking the conductive substrate (10) after soft baking each layer of photosensitive polymer (20).

10. A method for assembling particulates through the use of electrokinetic means, the method comprising:

a. providing a conductive substrate (10) comprising:

i. a plurality of electrodes disposed side-by-side, each electrode comprising a layer of photosensitive polymer (20) disposed on top of each electrode, wherein each layer of photosensitive polymer (20) is patterned with a plurality of windows (25) to expose the electrode underneath;

wherein, for each electrode, a bottom of each window of the plurality of windows (25) is made up entirely of the electrode;

b. providing an aqueous solution comprising a plurality of particulates and contacting each layer of photosensitive polymer (20) and each electrode; and c. applying non-uniform electrical signals to the plurality of electrodes (100), wherein the electrical signals cause the plurality of particulates to attract towards each electrode exposed by the plurality of windows (25).

11. The method of claim 10, wherein the method sorts the particulates by size, shape, density, conductivity, material composition, or permeability.

12. The method of claim 11, wherein the particulates are guided to each electrode by a combination of electroosmosis and dielectrophoresis.

13. The method of claim 10, wherein the particulates are microparticulates, nanoparticulates, or a combination thereof.

14. The method of claim 10, wherein the particulates are organic particulates, non-organic particulates, metallic particulates, or a combination thereof.

15. The method of claim 10, wherein the electrical signals are applied by a function generator (30).

16. The method of claim 10, wherein the method further comprises entrapping the plurality of particulates attracted to each electrode via electropolymerization.

17. The method of claim 10, wherein the electropolymerization comprises:

a. providing a polymerization solution;

b. mixing the polymerization solution with a particulate suspension;

c. depositing the polymerization solution and the particulate suspension over each electrode;

d. covering each electrode; and e. applying a non-uniform DC offset to each electrode (100) to entrap the plurality of particulates in place.

18. The method of claim 17, wherein the polymerization solution comprises an electropolymerization monomer and an ionic surfactant.

* * * * *